US011819732B1

(12) United States Patent
Wilson

(10) Patent No.: US 11,819,732 B1
(45) Date of Patent: Nov. 21, 2023

(54) EXERCISE DEVICE

(71) Applicant: Stephan Phillip Wilson, Eldridge, IA (US)

(72) Inventor: Stephan Phillip Wilson, Eldridge, IA (US)

( * ) Notice: Subject to any disclaimer, the term of this patent is extended or adjusted under 35 U.S.C. 154(b) by 42 days.

(21) Appl. No.: 17/319,086

(22) Filed: May 12, 2021

Related U.S. Application Data

(60) Provisional application No. 63/023,396, filed on May 12, 2020.

(51) Int. Cl.

| | |
|---|---|
| ***A63B 23/035*** | (2006.01) |
| ***A63B 21/055*** | (2006.01) |
| ***A63B 23/14*** | (2006.01) |
| ***A63B 23/12*** | (2006.01) |
| ***A63B 21/00*** | (2006.01) |
| ***A63B 21/04*** | (2006.01) |

(52) U.S. Cl.
CPC ..... *A63B 23/03508* (2013.01); *A63B 21/055* (2013.01); *A63B 23/1281* (2013.01); *A63B 23/14* (2013.01); *A63B 21/00185* (2013.01); *A63B 21/0407* (2013.01); *A63B 21/0435* (2013.01)

(58) Field of Classification Search
CPC ..... A63B 21/055; A63B 21/00058; A63B 21/00061; A63B 21/00178; A63B 21/00185; A63B 21/04; A63B 21/0407; A63B 21/0435; A63B 21/0442; A63B 21/0552; A63B 21/4015; A63B 21/4019; A63B 21/4023; A63B 21/4025; A63B 21/4033; A63B 21/4034; A63B 21/4035; A63B 21/4047; A63B 23/03508; A63B 23/1218; A63B 23/14
See application file for complete search history.

(56) References Cited

U.S. PATENT DOCUMENTS

| | | | | |
|---|---|---|---|---|
| D244,628 | S | 6/1977 | Wright | |
| 4,544,155 | A | 10/1985 | Wallenbrock et al. | |
| 5,674,162 | A | 10/1997 | Ellingson et al. | |
| 5,709,637 | A | 1/1998 | Gow et al. | |
| 5,766,112 | A | 6/1998 | Chuan | |
| 6,500,102 | B1 | 12/2002 | Domenge | |
| 7,094,182 | B1 | 8/2006 | Holten | |
| 7,473,213 | B1 * | 1/2009 | Kallenbach | A63B 21/4017 16/428 |
| 7,585,262 | B1 | 9/2009 | Vayntraub | |
| 7,819,789 | B2 | 10/2010 | Berman et al. | |
| 8,172,727 | B2 | 5/2012 | Berman et al. | |

(Continued)

*Primary Examiner* — Megan Anderson
(74) *Attorney, Agent, or Firm* — Simmons Perrine Moyer Bergman PLC

(57) ABSTRACT

A method for treating pronator syndrome involves selecting an arm and positioning it with the forearm perpendicular to the upper arm. The hand of the arm is engaged with a grip located inside a bisected working circle, which has an outer perimeter consisting of four quadrants. The fourth quadrant is elliptical and asymmetrical to the others. The grip is designed for hand engagement and includes two d-shaped slots. A resistance band is attached to the body, with one end in the groove, creating tension when used. To exercise the arm, the body is rotated in one direction to increase tension on the band. Releasing tension is achieved by rotating the body in the opposite direction.

11 Claims, 20 Drawing Sheets

(56) References Cited

U.S. PATENT DOCUMENTS

| | | | |
|---|---|---|---|
| 8,556,783 | B1 | 10/2013 | Ihli et al. |
| 8,814,765 | B2 | 8/2014 | Bernstein |
| D733,815 | S | 7/2015 | Gustafson |
| 9,149,676 | B2 | 10/2015 | Callanan |
| D745,097 | S | 12/2015 | Webb |
| 9,833,653 | B2 | 12/2017 | Bradford |
| 9,873,015 | B2 | 1/2018 | Jolly |
| 10,010,470 | B2 | 7/2018 | Bradford |
| 10,143,883 | B2 | 12/2018 | Jolly |
| 2003/0134727 | A1 | 7/2003 | Yu |
| 2005/0096200 | A1 | 5/2005 | Amann |
| 2010/0190620 | A1 | 7/2010 | Chen et al. |
| 2013/0184123 | A1 | 7/2013 | McLoughney |
| 2016/0346594 | A1* | 12/2016 | Homewood ..... A63B 21/075 |

* cited by examiner

EXERCISE DEVICE

CROSS REFERENCE TO RELATED APPLICATIONS

Applicant states that this application claims the benefit of U.S. Pat. App. No. 63/023,396 filed on May 12, 2020, which is incorporated by reference herein in its entirety.

FIELD OF THE INVENTION

The present disclosure relates to the facilitation of strengthening of the wrist and forearm as may be useful particular to the treatment of medial epicondylitis, also known as golfer's elbow, and/or lateral epicondylitis, also known as tennis elbow, for example, without limitation. Additionally, the Exercise Device as disclosed herein may be useful in the treatment of pronator syndrome and for improvement of general weakness following upper extremity surgery.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

The exercise device allows a user to exercise by providing a resistance to the movement of a user's wrist and forearm and may be useful in the therapeutic treatment of golfers' and tennis elbow. It would be especially useful when utilized under the direction of a physical therapist during the rehabilitation process following a fracture, sprain, or arthritis. The device includes two components: a body configured as a bisected working circle, a resistance band and a handle. The resistance band can be selected having variety of resistances as required or desired for a particular application. Dependent on the different treatments desired, the device can be held through the handle which may configured with different thicknesses to accommodate a range of hand sizes. The application of the device is not limited to the rehabilitation process and using the device would allow one to strengthen their wrist while reducing the specter of injury.

BACKGROUND OF PRIOR ART

Gow et. al discusses using the device disclosed in U.S. Pat. No. 5,709,637 to address and provide the optimal route to essential synergy in the training of the rotator cuff muscles by way of eccentric (not simply linear) control, using a resistance device which provides continuous resistance through the full rotational range of the shoulder joint. The Gow device disclosed, however, does not use the concepts disclosed to actually address and provide eccentric control because the Gow device is circular and symmetrical which is the opposite of eccentric (not simply linear). Unlike Gow, the invention as disclosed herein, is elliptical and non-symmetrical to improve upon general weakness in the lower portion of an upper extremity following surgery, through exercise and physical therapy treatment, which provides for eccentric exercise. The present device may also be used to address wrist and forearm related ailments including pronator syndrome, tennis and golfer's elbow.

DETAILED DESCRIPTION—BRIEF DESCRIPTION OF DRAWINGS

Figure 2A:
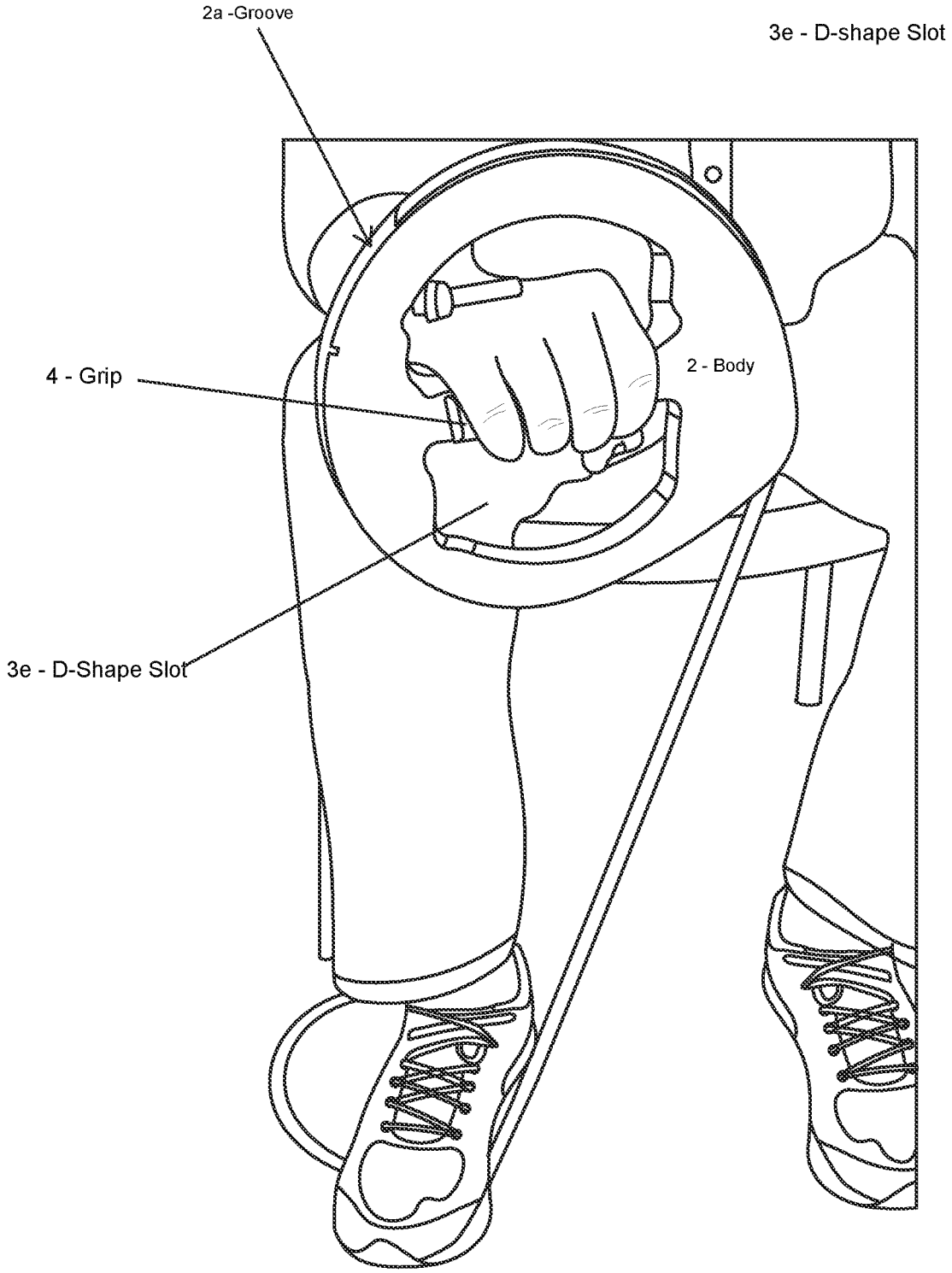
FIG. 2A is a perspective view of a user positioned to use the exercise device wherein the user's right hand is engaged with the handle of the exercise device prior to supination (turning out) of the user's hand and arm is horizontal to the floor (0 degrees or parallel).
Figure 2B:
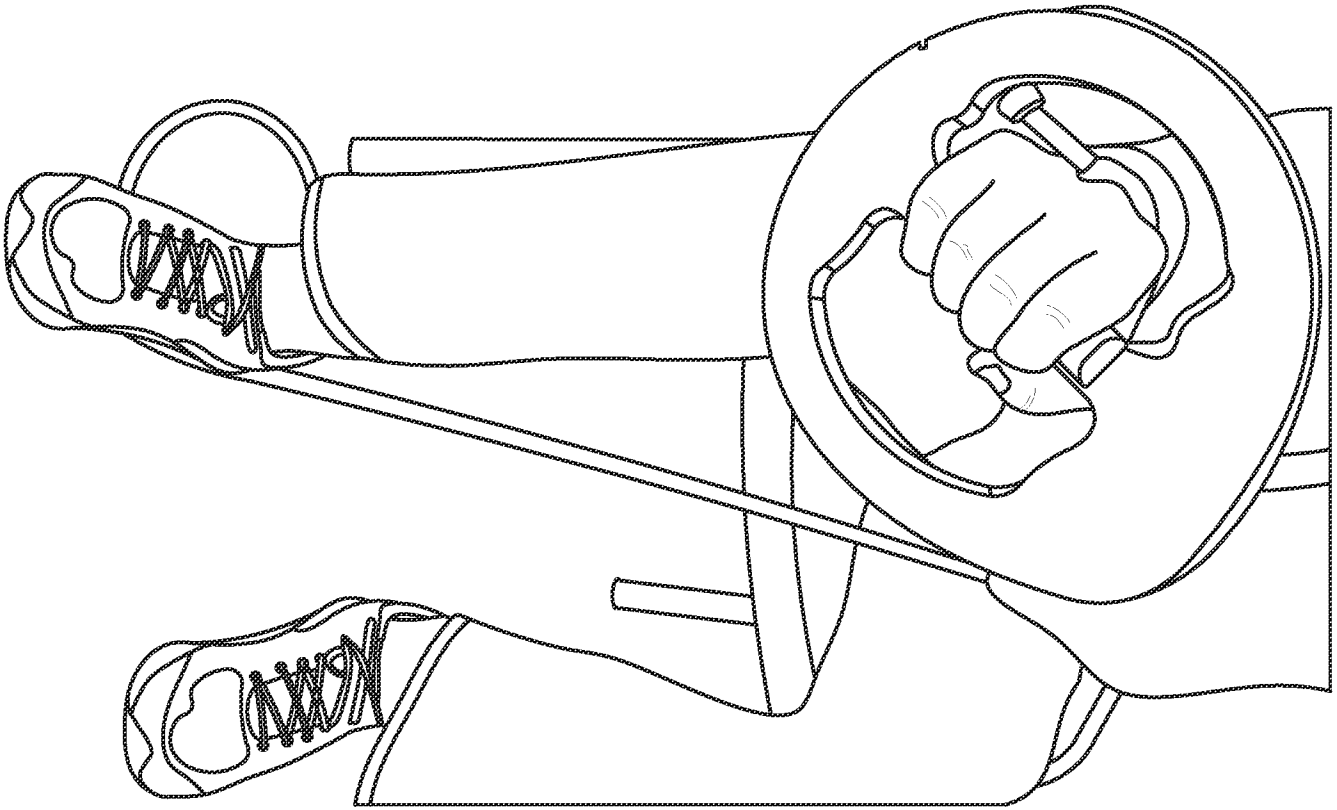

FIG. 2B is a perspective view of a user positioned using the exercise device wherein the user's right hand is engaged with the handle of the exercise device during supination (turning out) of the user's hand and arm, the handle turned 90 degrees relative to the first position shown in FIG. 2A. As shown the increased radius of the working quadrant of the exercise device increases the resistance that must be overcome by the user to turn the exercise device out to the end position, thereby increasing the effort or work to be done by the user thereby increasing the efficacy of the exercise device to enhance strength or recovery of the wrist and forearm.

Figure 2C:
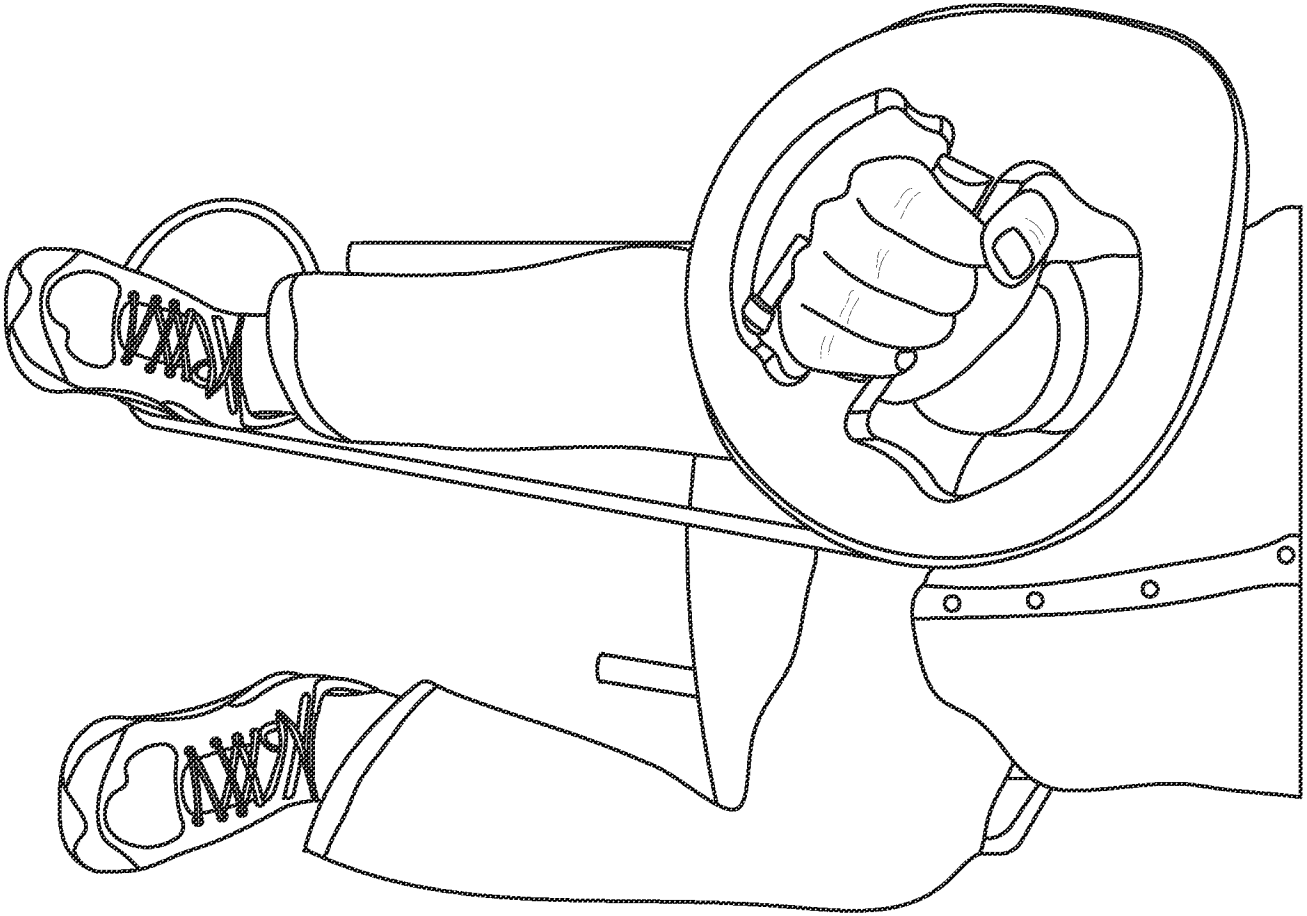

FIG. 2C is a perspective view of a user positioned using the exercise device wherein the user's right hand is engaged with the handle of the exercise device during supination (turning out) of the user's hand and arm, the handle turned 135 degrees relative to the first position shown in FIG. 2A.

Figure 3A:
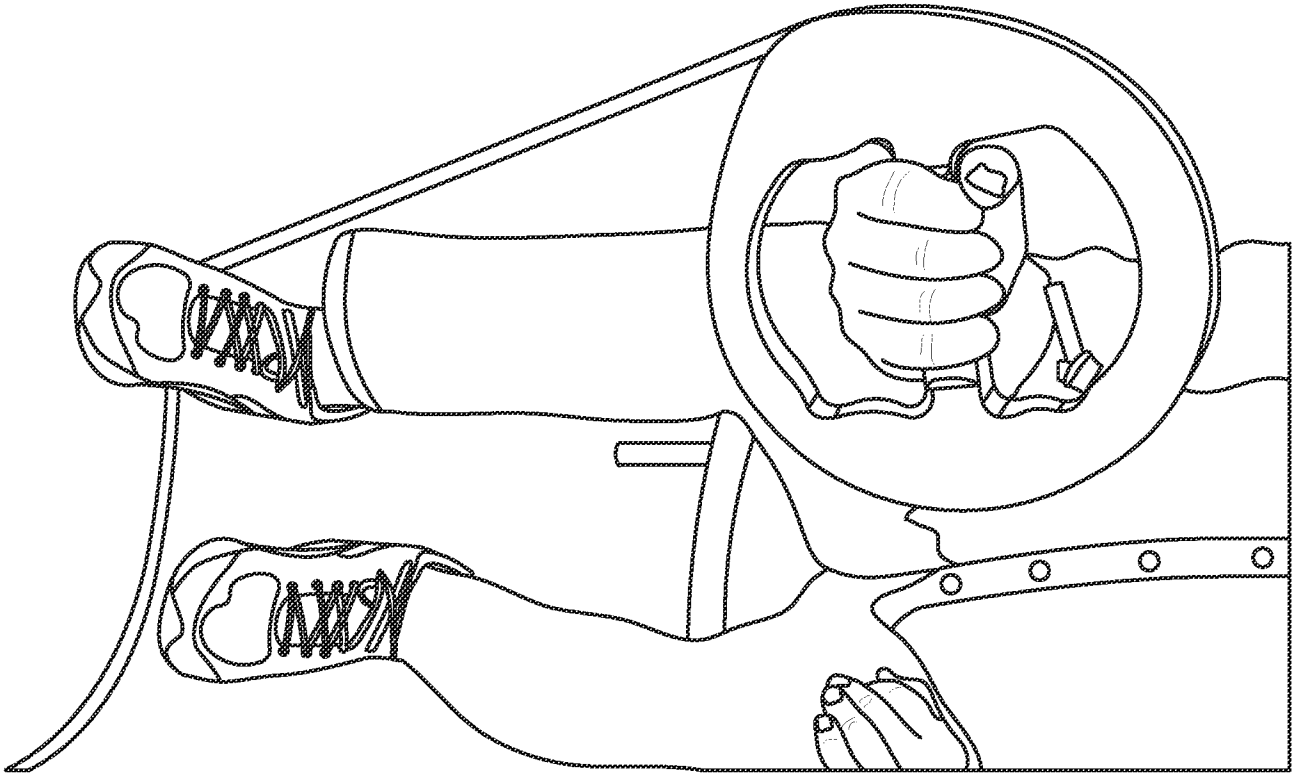

FIG. 3A is a perspective view of a user positioned to use the exercise device wherein the user's right hand is engaged with the handle of the exercise device prior to pronation (turning in) of the user's hand and the arm is horizontal (0 degrees or parallel).

Figure 3B:
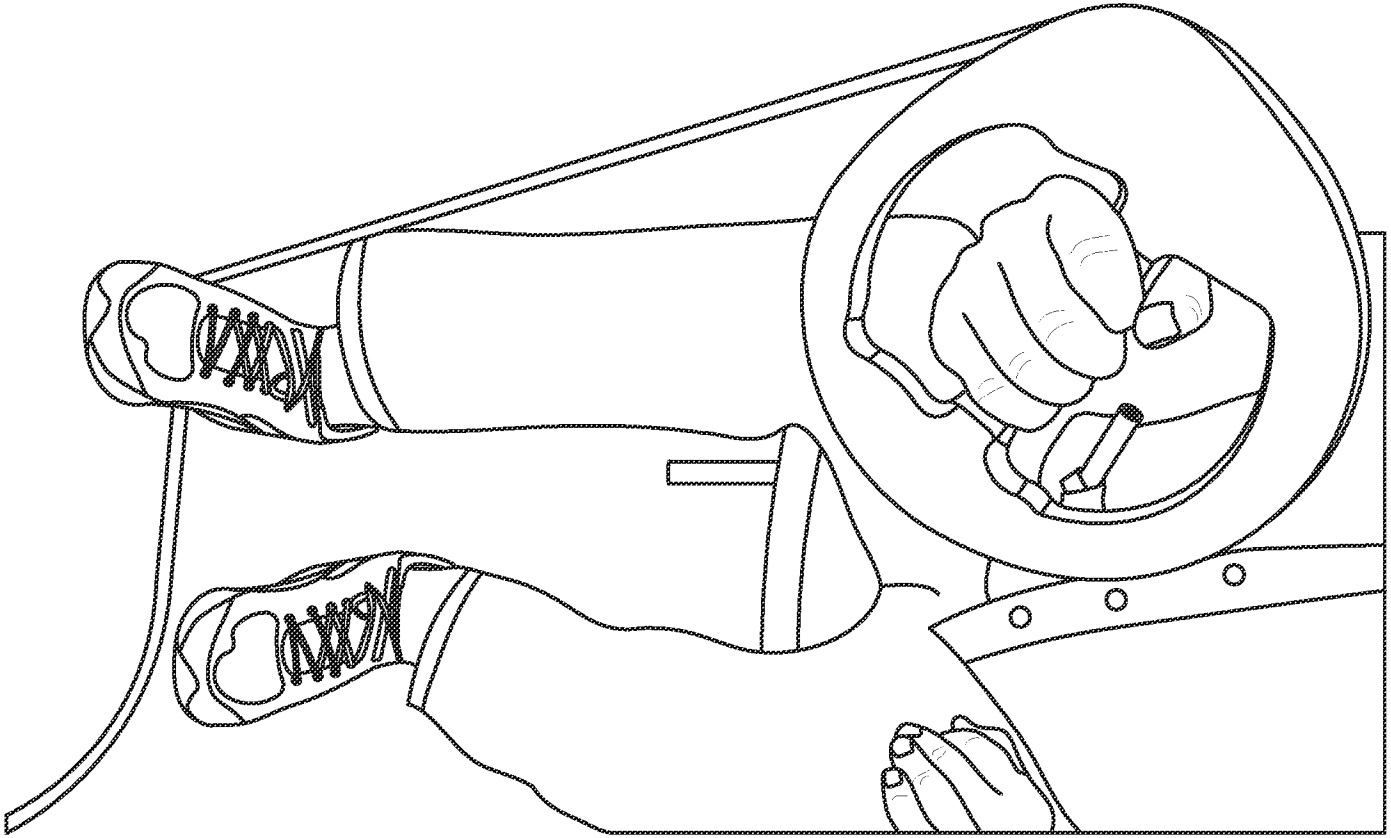

FIG. 3B is a perspective view of a user positioned using the exercise device wherein the user's right hand is engaged with the handle of the exercise device during pronation (turning in) of the user's hand and arm, the handle turned 90 degrees relative to the first position shown in FIG. 3A.

Figure 3C:
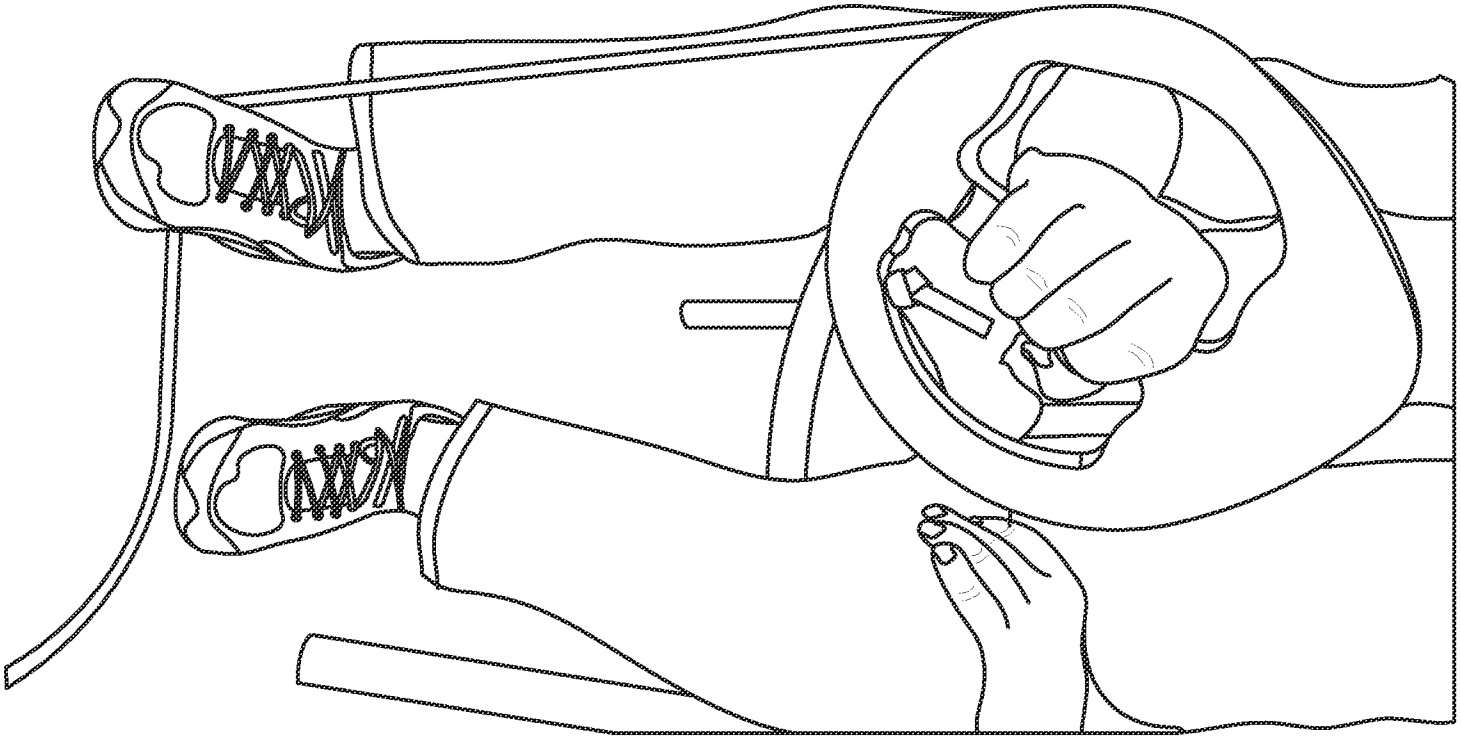

FIG. 3C is a perspective view of a user positioned using the exercise device wherein the user's right hand is engaged with the handle of the exercise device during pronation (turning out) of the user's hand and arm, the handle turned 135 degrees relative to the first position shown in FIG. 3A.

Figure 4:
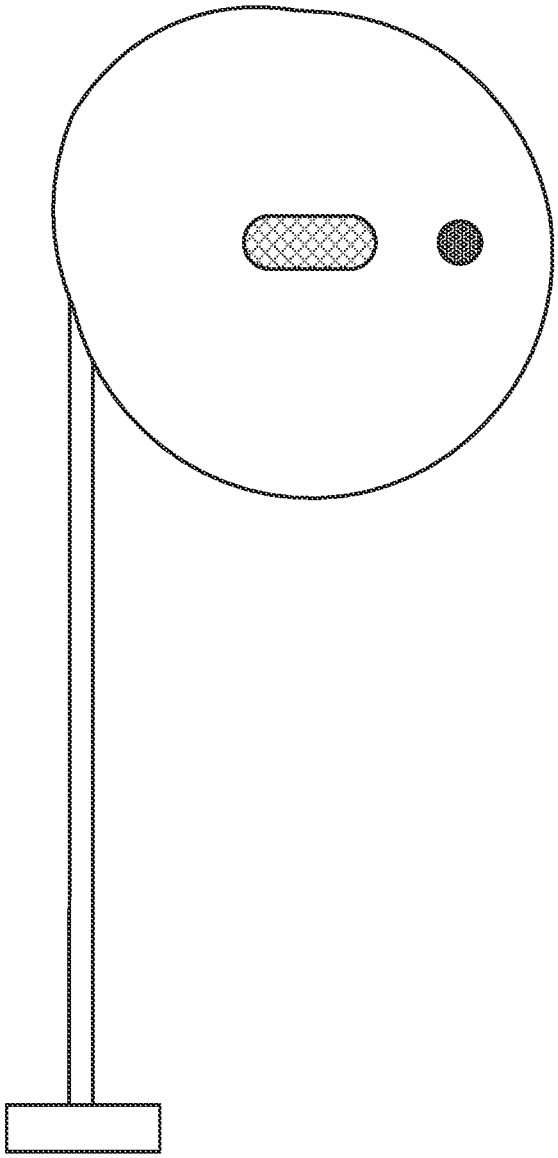

FIG. 4 is a side view of another embodiment of the exercise device disclosed herein using two elliptical working discs having a handle which is circular and connects the two elliptical working discs. As shown, the exercise device outer perimeter is composed of four quadrants, with one quadrant defined as a working quadrant which is elliptical (non-circular) with the remaining quadrants circular and generally symmetrical to each other.

Figure 4A:
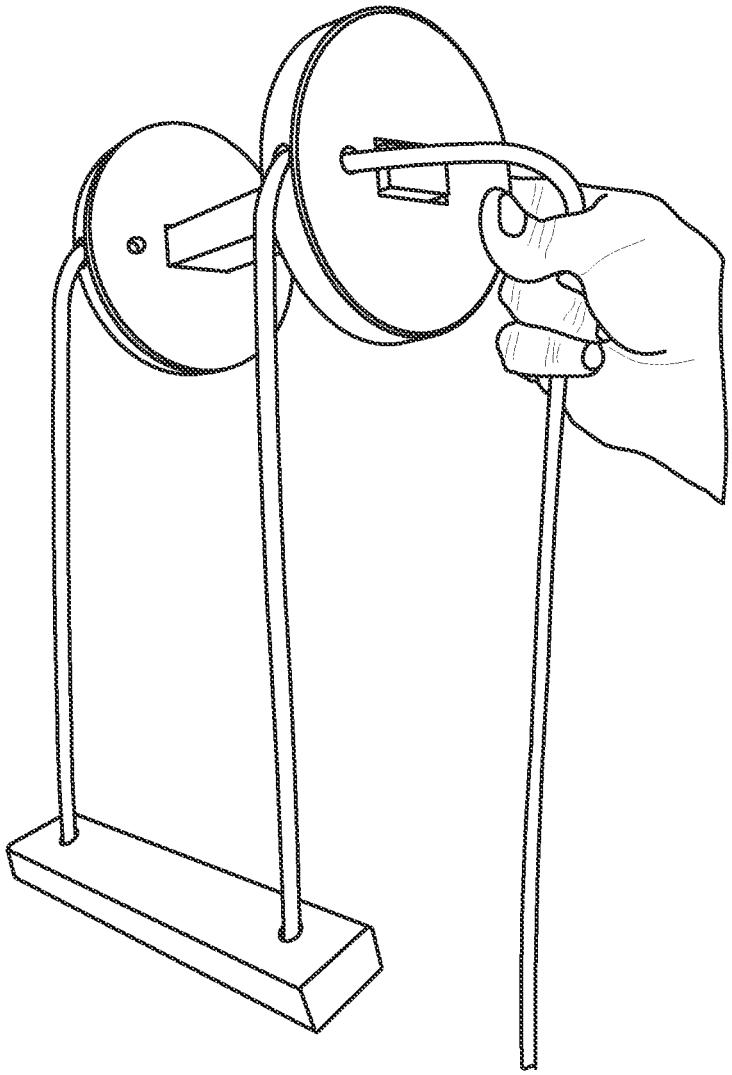

FIG. 4A is a perspective view of the exercise device of FIG. 4.

Figure 4B:
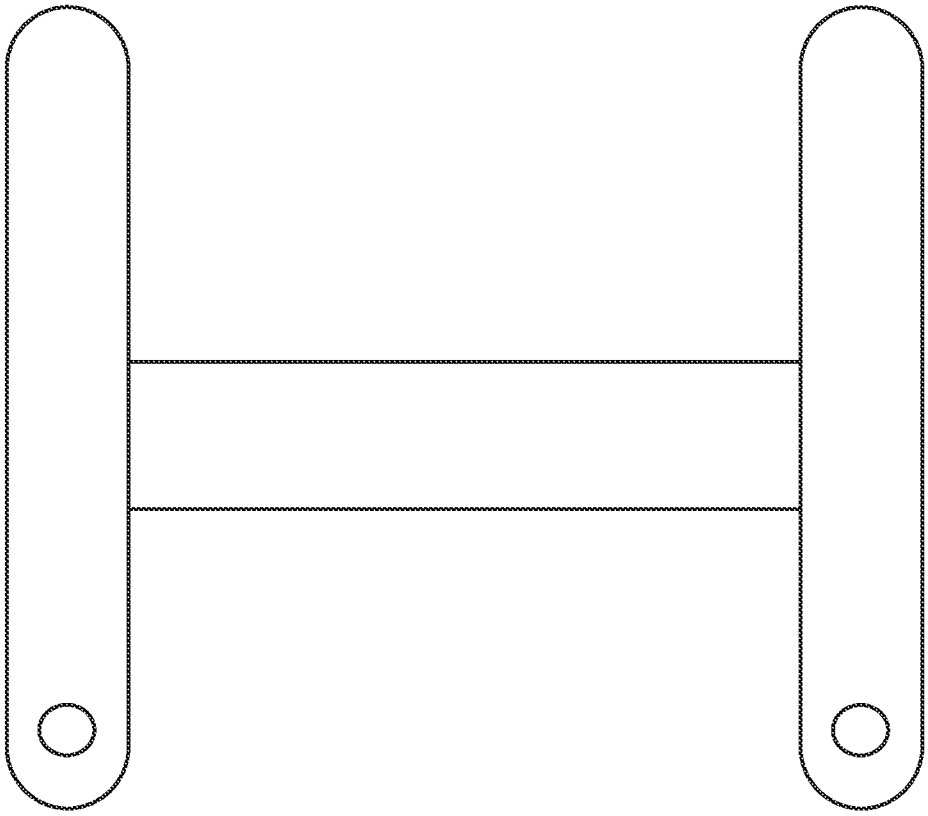

FIG. 4B is a top view of the exercise device of FIG. 4.

Figure 4C:
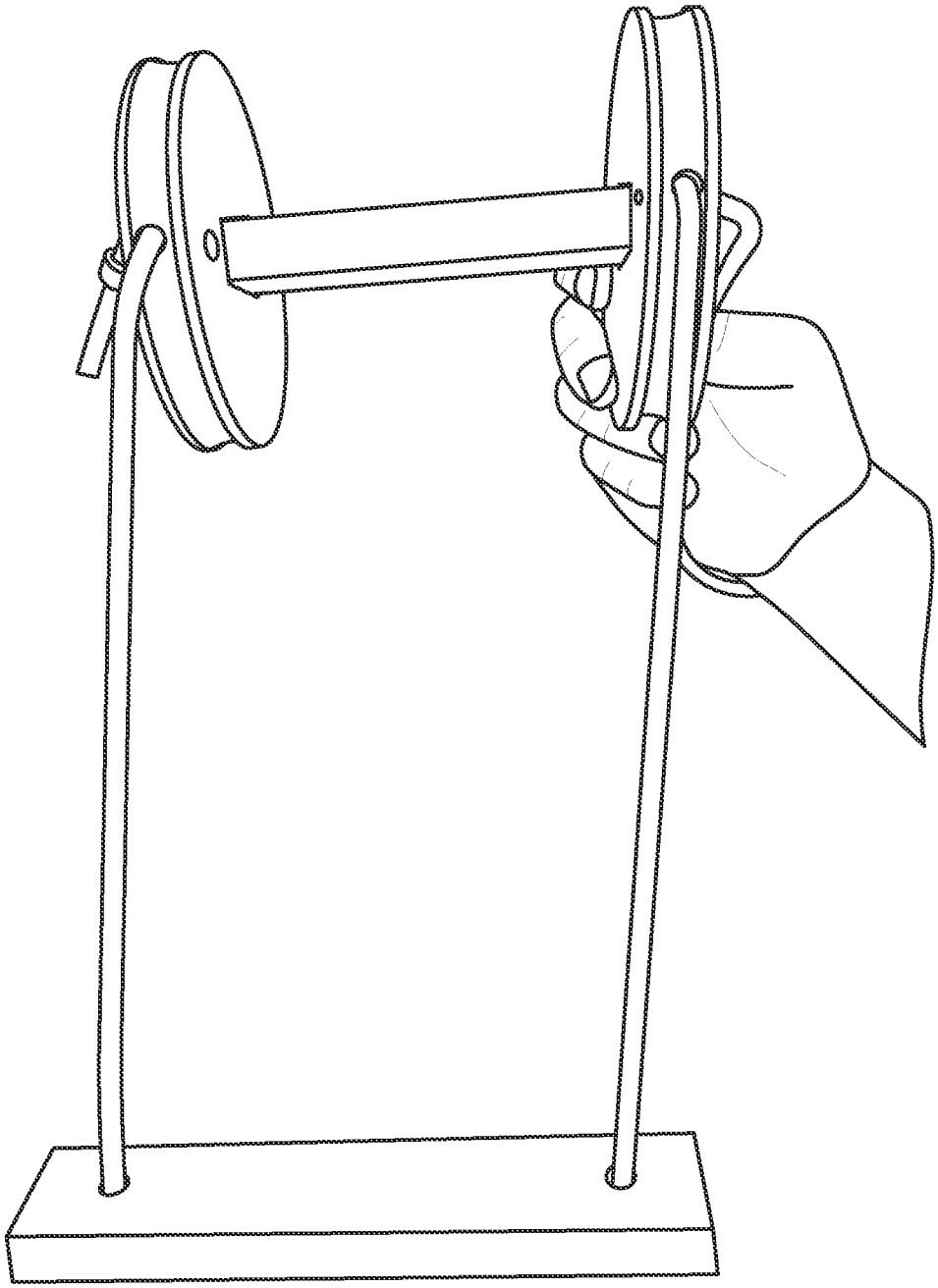

FIG. 4C is a front view of the exercise device of FIG. 4.

Figure 5A:
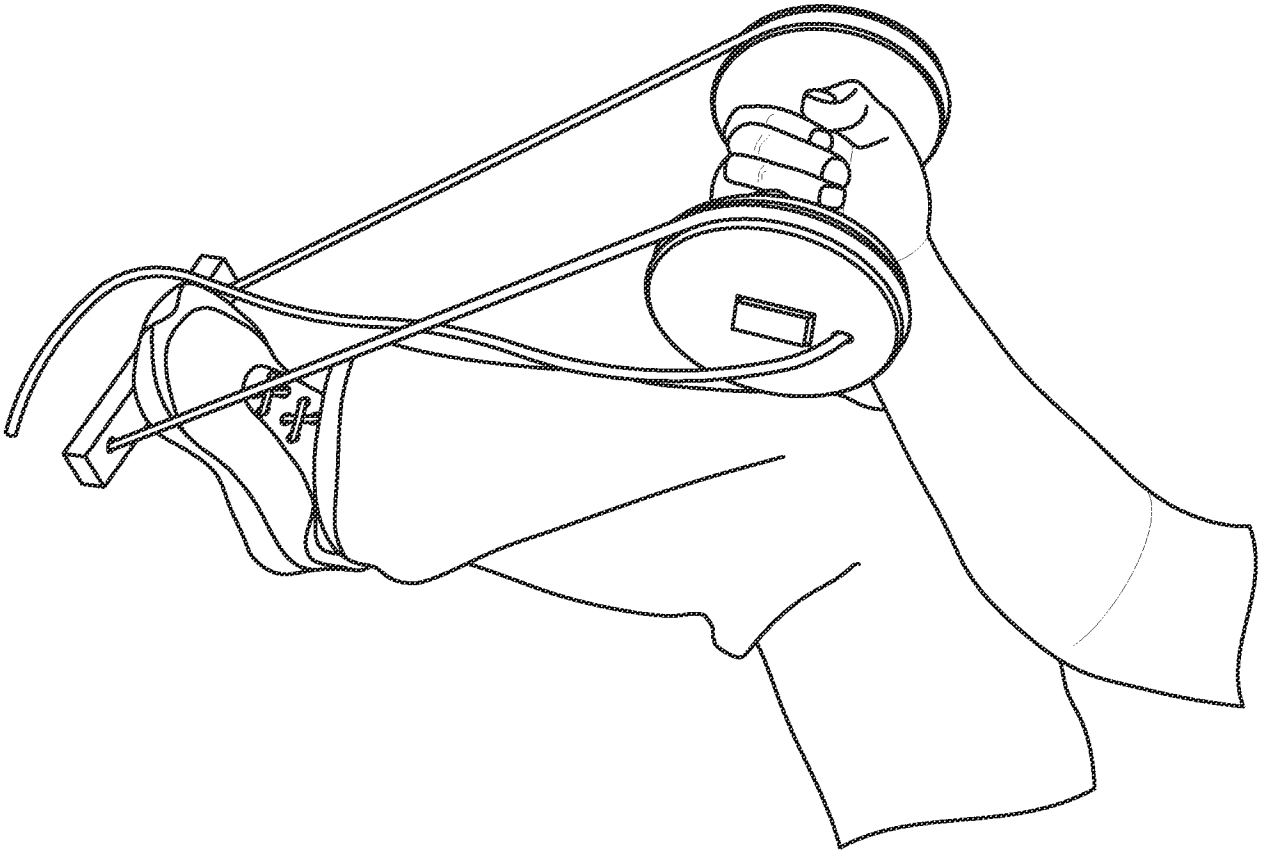

FIG. 5A is a perspective view of a user positioned to use the exercise device wherein the user's right hand is engaged with the handle of the exercise device in supination (palm facing up) prior to flexion of the wrist, and the user's arm is horizontal (parallel) to the floor. (should be elliptical vs. circles)

Figure 5B:
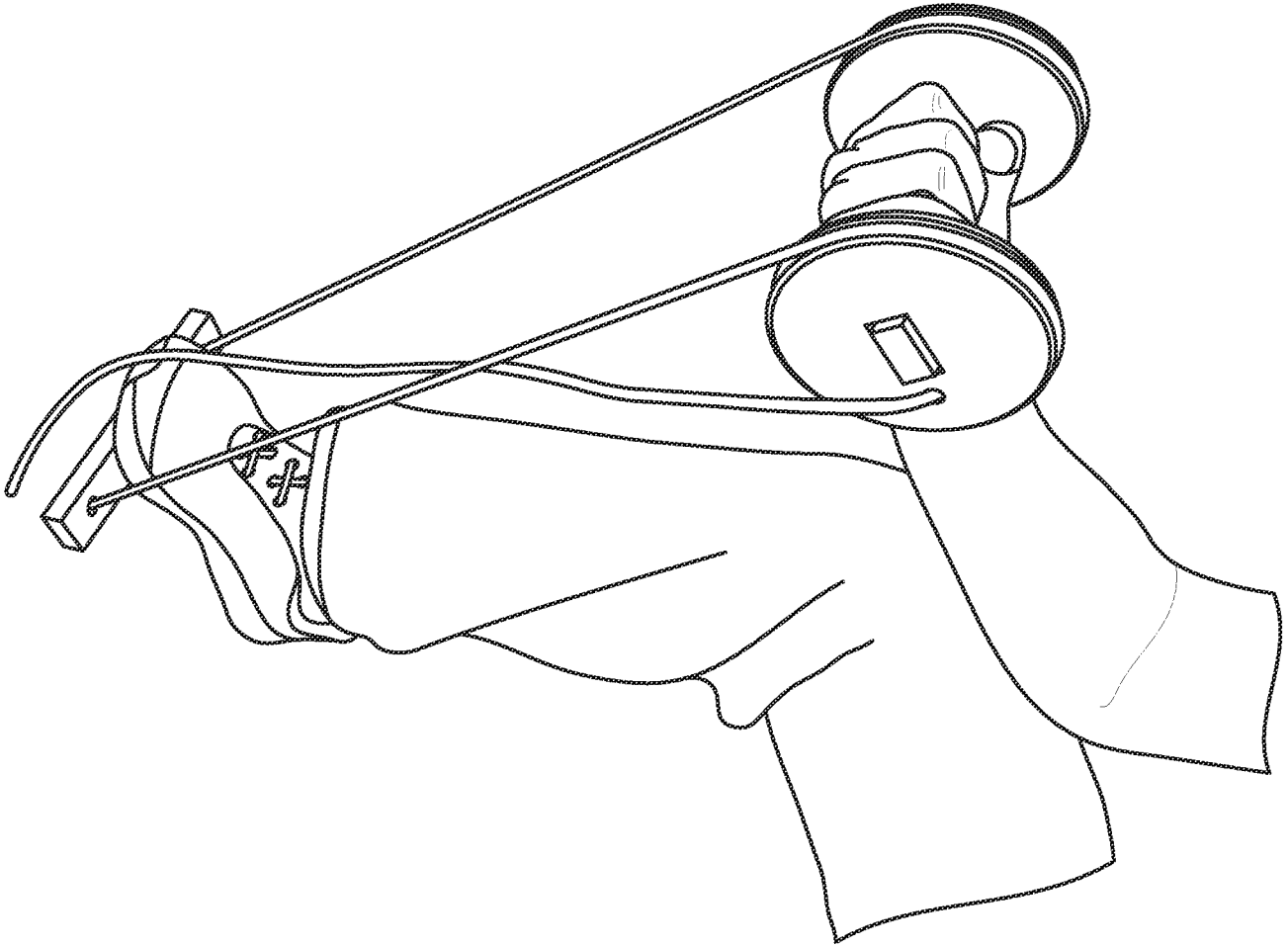

FIG. 5B is a perspective view of a user positioned to use the exercise device wherein the user's right hand is engaged with the handle of the exercise device in supination (palm facing up) during flexion of the wrist, and the user's arm is horizontal (parallel) to the floor.

Figure 5C:
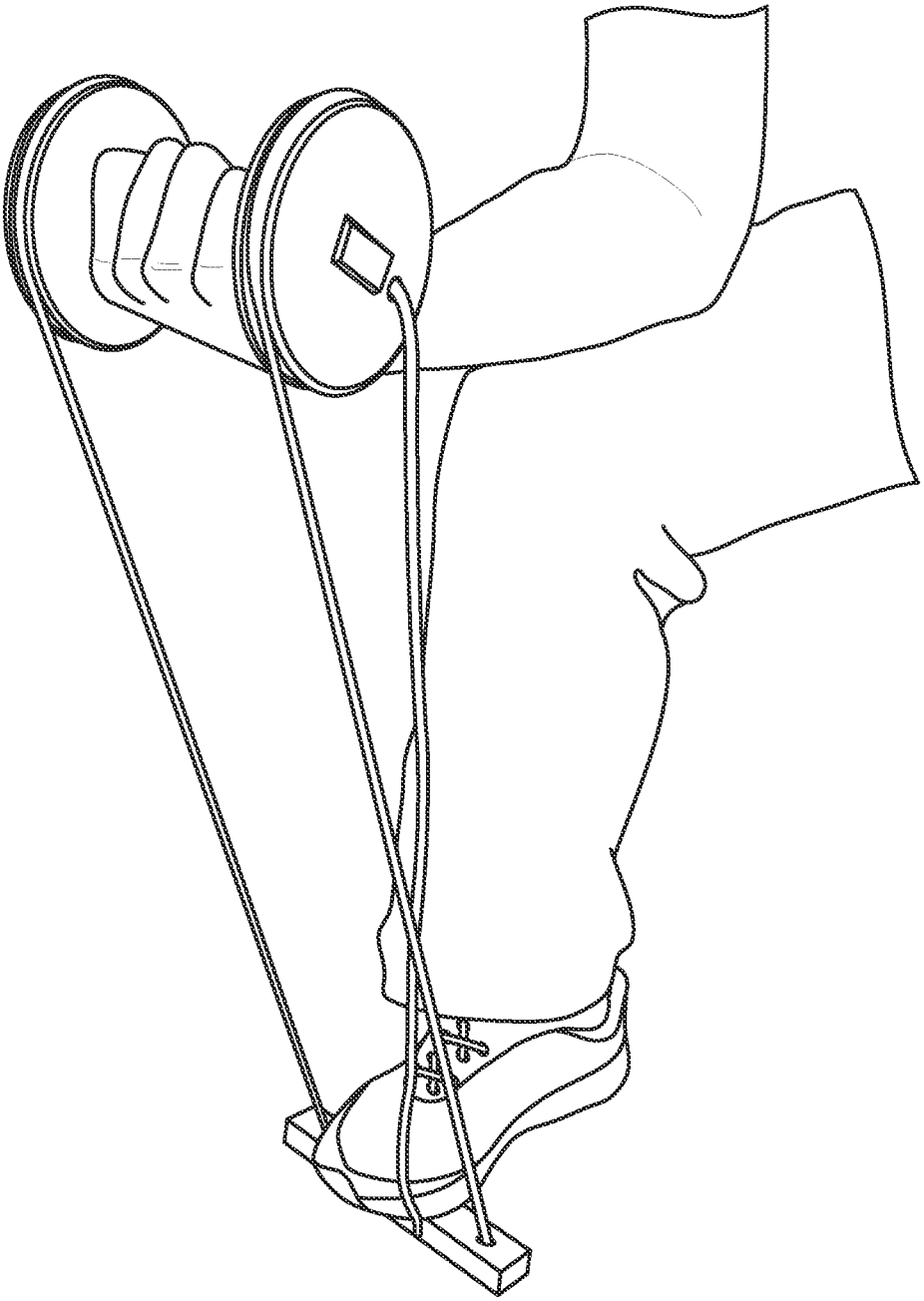

FIG. 5C is a perspective view of a user positioned to use the exercise device wherein the user's right hand is engaged with the handle of the exercise device in supination (palm facing up) at the end of flexion of the wrist (end of the exercise), and the user's arm is horizontal (parallel) to the floor.

Figure 6A:
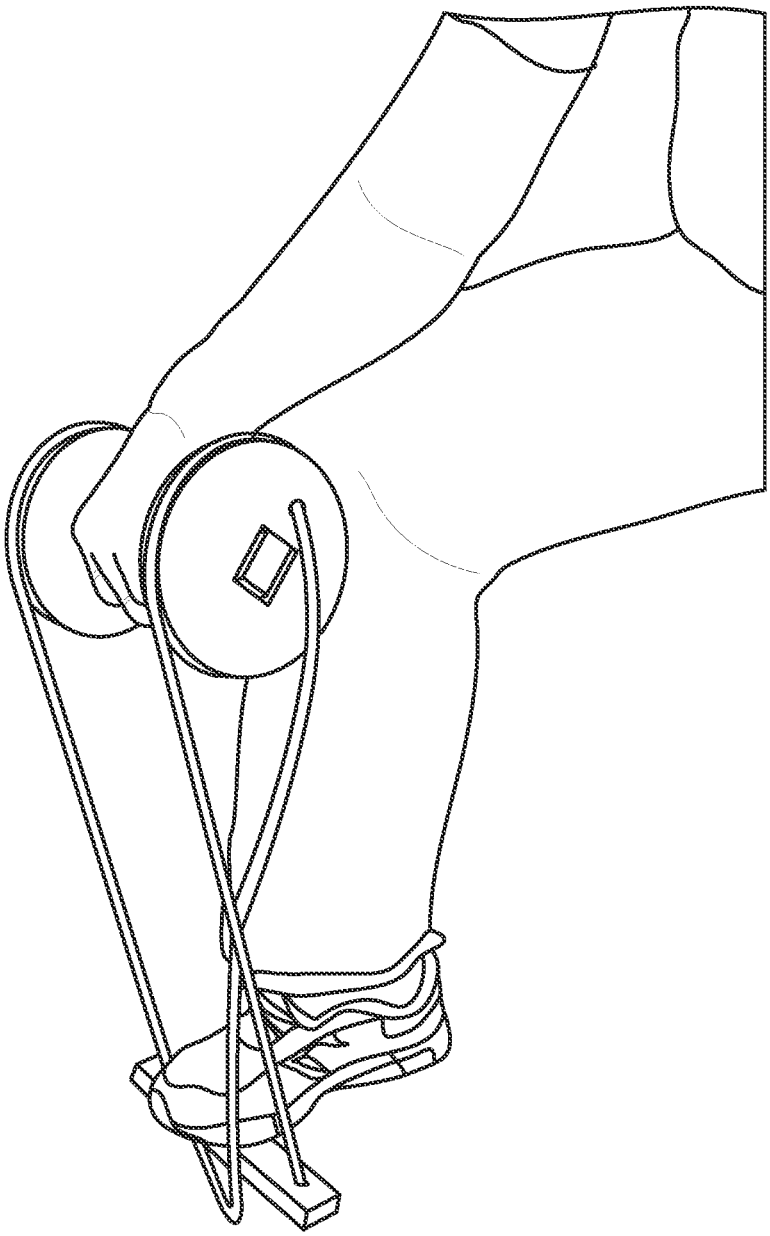

FIG. 6A is a perspective view of a user positioned to use the exercise device wherein the user's right hand is engaged with the handle of the exercise device in pronation (palm facing down) prior to extension of the wrist, and the user's arm is horizontal (parallel) to the floor.

Figure 6B:
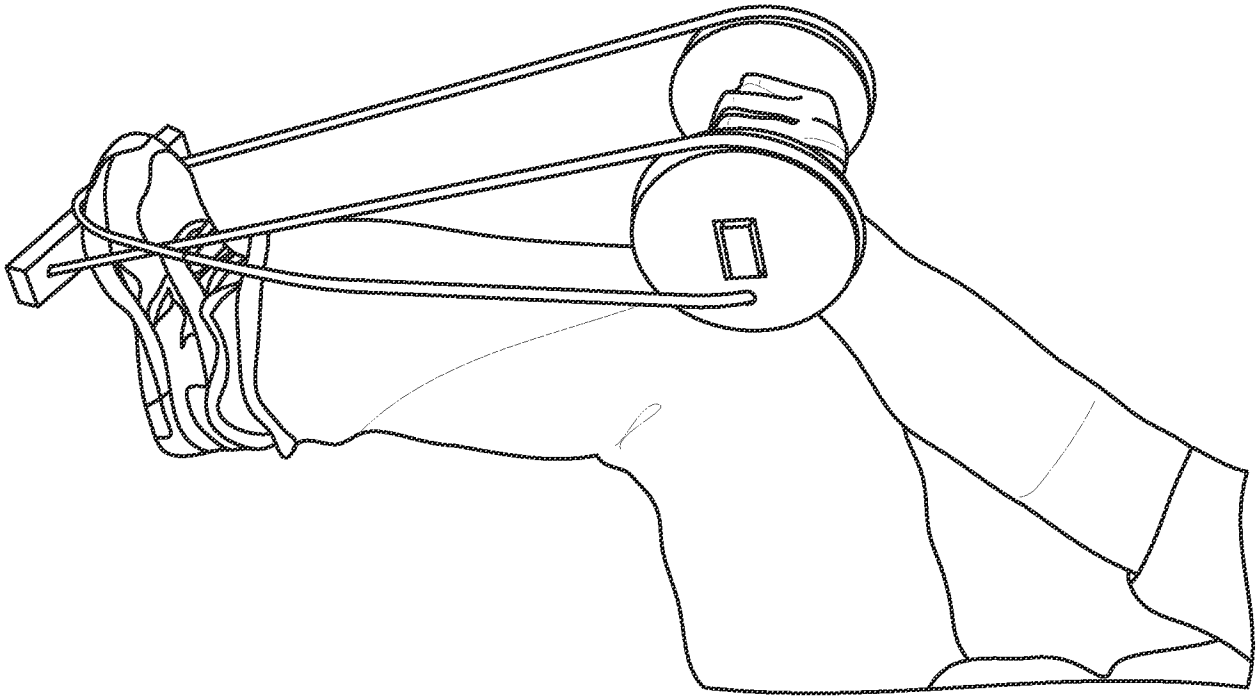

FIG. 6B is a perspective view of a user positioned to use the exercise device wherein the user's right hand is engaged with the handle of the exercise device in pronation (palm facing down) during extension of the wrist, and the user's arm is horizontal (parallel) to the floor.

Figure 6C:
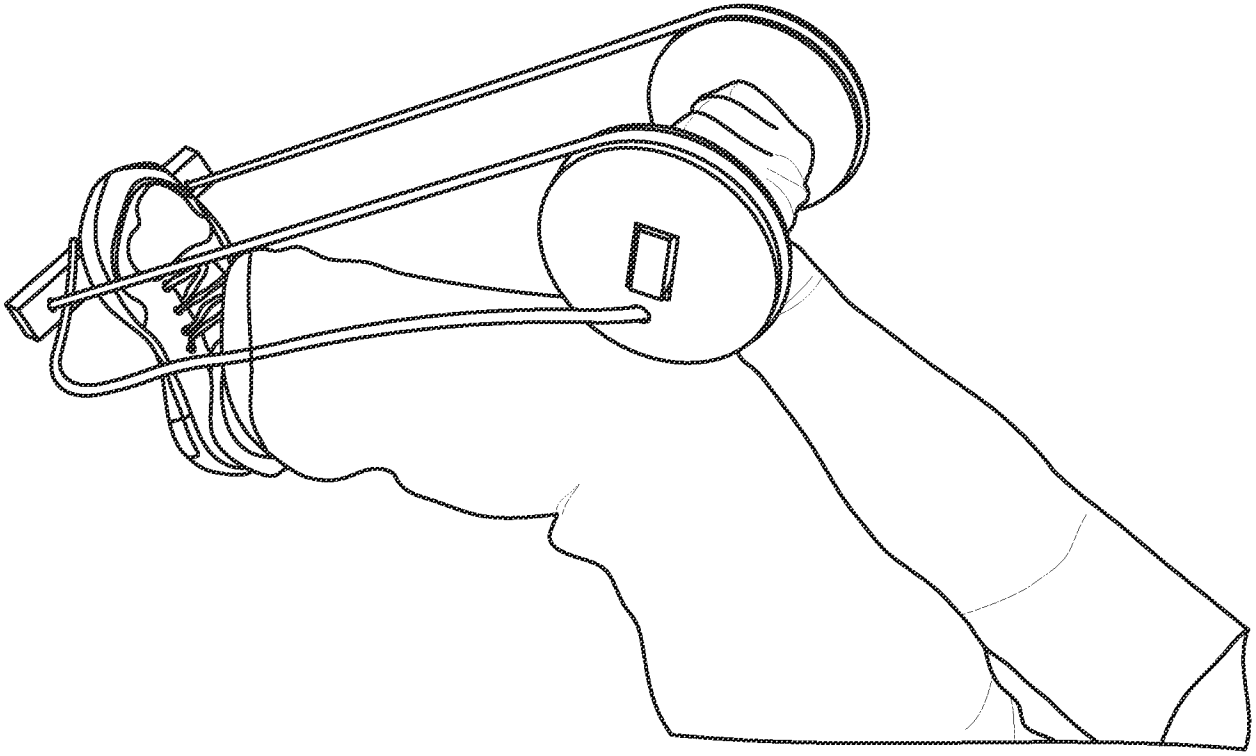

FIG. 6C is a perspective view of a user positioned to use the exercise device wherein the user's right hand is engaged with the handle of the exercise device in pronation (palm facing down) at the end of extension of the wrist (end of the exercise), and the user's arm is horizontal (parallel) to the floor.

DETAILED DESCRIPTION - LISTING OF ELEMENTS

| Element Description | Element Number |
|---|---|
| Body/Bisected working circle | 2 |
| Groove | 2a |
| Perimeter of Working Circle | 3 |
| Quadrant I portion | 3a |
| Quadrant II portion | 3b |
| Quadrant III portion | 3c |
| Quadrant IV portion | 3d |
| D-shape handle opening | 3e |
| Resistance band hole | 3f |
| Grip | 4 |
| Grip - double disc embodiment | 4a |
| Foot brace | 8 |
| Exercise device | 10 |
| Resistance band | 11 |
| First end | 11a |
| Second end | 11b |
| User | 20 |
| Arm | 20a |
| Wrist | 20b |

-continued

DETAILED DESCRIPTION - LISTING OF ELEMENTS

| Element Description | Element Number |
|---|---|
| Hand | 20c |
| Foot | 20d |
| Floor | 30 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

ILLUSTRATIVE EMBODIMENT AND ADVANTAGES OF INVENTION

Figure 1:
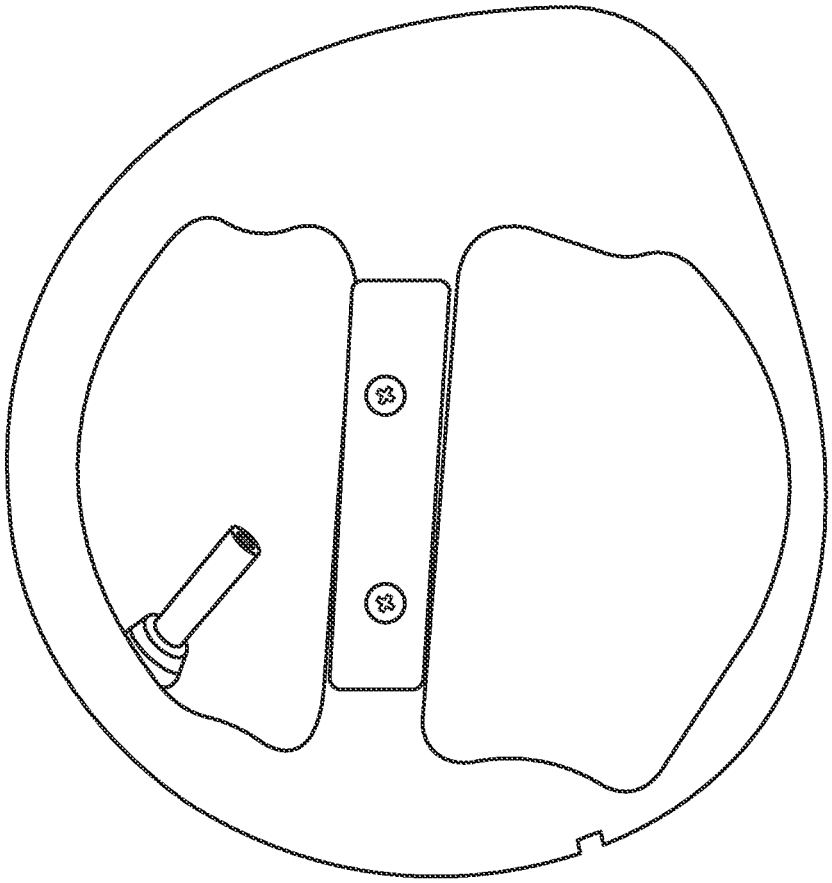
FIG. 1 is a side view of an exercise device having a handle across the interior perimeter which is circular and symmetrical. As shown, the exercise device outer perimeter is composed of four quadrants, with one quadrant defined as a working quadrant which is elliptical (non-circular) with the remaining quadrants circular and generally symmetrical to each other.

FIG. 1 is a side view of an exercise device having a handle across the interior perimeter which is circular and symmetrical. As shown, the exercise device outer perimeter is composed of four quadrants, with one quadrant defined as a working quadrant which is elliptical (non-circular) with the remaining quadrants circular and generally symmetrical to each other.

Figure 1A:
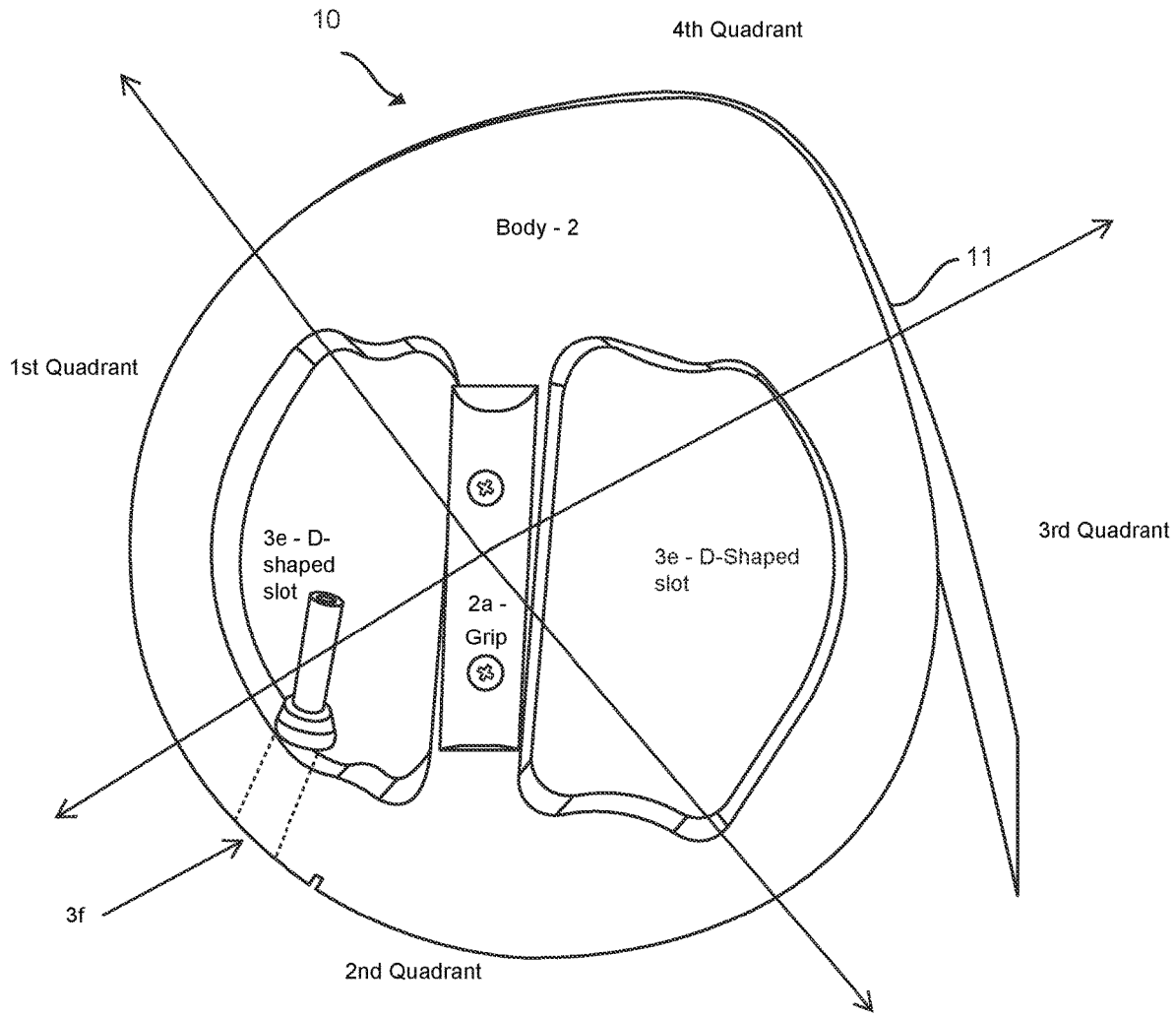
FIG. 1A is a perspective view of the exercise device of FIG. 1.

FIG. 1A is a perspective view of the exercise device of FIG. 1.

Figure 1B:
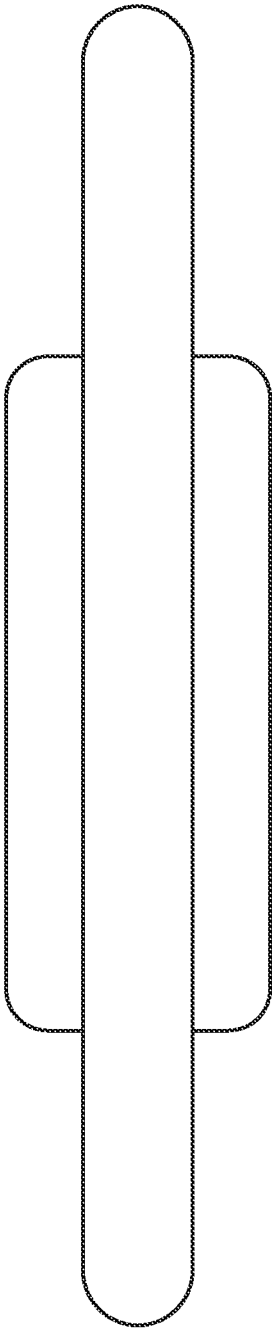
FIG. 1B is a top view of the exercise device of FIG. 1.

FIG. 1B is a top view of the exercise device of FIG. 1.

Figure 1C:
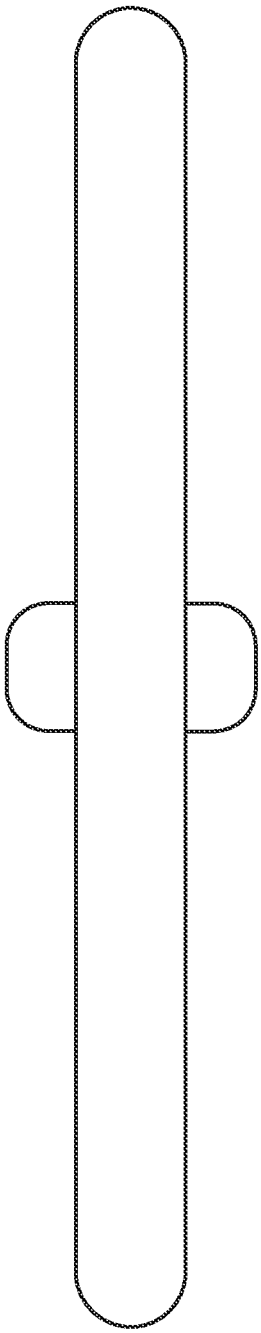
FIG. 1C is a front view of the exercise device of FIG. 1.

FIG. 1C is a front view of the exercise device of FIG. 1.

FIG. 2A is a perspective view of a user positioned to use the exercise device wherein the user's right hand is engaged with the handle of the exercise device prior to supination (turning out) of the user's hand and arm is horizontal to the floor (0 degrees or parallel).

FIG. 2B is a perspective view of a user positioned using the exercise device wherein the user's right hand is engaged with the handle of the exercise device during supination (turning out) of the user's hand and arm, the handle turned 90 degrees relative to the first position shown in FIG. 2A. As shown the increased radius of the working quadrant of the exercise device increases the resistance that must be overcome by the user to turn the exercise device out to the end position, thereby increasing the effort or work to be done by the user thereby increasing the efficacy of the exercise device to enhance strength or recovery of the wrist and forearm.

FIG. 2C is a perspective view of a user positioned using the exercise device wherein the user's right hand is engaged with the handle of the exercise device during supination (turning out) of the user's hand and arm, the handle turned 135 degrees relative to the first position shown in FIG. 2A.

FIG. 3A is a perspective view of a user positioned to use the exercise device wherein the user's right hand is engaged with the handle of the exercise device prior to pronation (turning in) of the user's hand and the arm is horizontal (0 degrees or parallel).

FIG. 3B is a perspective view of a user positioned using the exercise device wherein the user's right hand is engaged with the handle of the exercise device during pronation (turning in) of the user's hand and arm, the handle turned 90 degrees relative to the first position shown in FIG. 3A.

FIG. 3C is a perspective view of a user positioned using the exercise device wherein the user's right hand is engaged with the handle of the exercise device during pronation (turning out) of the user's hand and arm, the handle turned 135 degrees relative to the first position shown in FIG. 3A.

FIG. 4 is a side view of another embodiment of the exercise device disclosed herein using two elliptical working discs having a handle which is circular and connects the two elliptical working discs. As shown, the exercise device outer perimeter is composed of four quadrants, with one quadrant defined as a working quadrant which is elliptical (non-circular) with the remaining quadrants circular and generally symmetrical to each other.

FIG. 4A is a perspective view of the exercise device of FIG. 4.

FIG. 4B is a top view of the exercise device of FIG. 4.

FIG. 4C is a front view of the exercise device of FIG. 4.

FIG. 5A is a perspective view of a user positioned to use the exercise device wherein the user's right hand is engaged with the handle of the exercise device in supination (palm facing up) prior to flexion of the wrist, and the user's arm is horizontal (parallel) to the floor. (should be elliptical vs. circles)

FIG. 5B is a perspective view of a user positioned to use the exercise device wherein the user's right hand is engaged with the handle of the exercise device in supination (palm facing up) during flexion of the wrist, and the user's arm is horizontal (parallel) to the floor.

FIG. 5C is a perspective view of a user positioned to use the exercise device wherein the user's right hand is engaged with the handle of the exercise device in supination (palm facing up) at the end of flexion of the wrist (end of the exercise), and the user's arm is horizontal (parallel) to the floor.

FIG. 6A is a perspective view of a user positioned to use the exercise device wherein the user's right hand is engaged with the handle of the exercise device in pronation (palm facing down) prior to extension of the wrist, and the user's arm is horizontal (parallel) to the floor.

FIG. 6B is a perspective view of a user positioned to use the exercise device wherein the user's right hand is engaged with the handle of the exercise device in pronation (palm facing down) during extension of the wrist, and the user's arm is horizontal (parallel) to the floor.

FIG. 6C is a perspective view of a user positioned to use the exercise device wherein the user's right hand is engaged with the handle of the exercise device in pronation (palm facing down) at the end of extension of the wrist (end of the exercise), and the user's arm is horizontal (parallel) to the floor.

While certain specific embodiments have been described in detail, it is understood that the present disclosure will be appreciated by those skilled in the art and will be developed considering the overall teaching of the disclosure. Accordingly, the embodiments disclosed herein should not be construed as limitation on the scope of the invention, but should be determined by the appended claims and their legal equivalents. As one of ordinary skill will appreciate the present disclosure is not limited by the means of construction or the materials chosen as other suitable materials, including plastic, steel or aluminum, and combinations therein.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

It should be noted that particular embodiment are not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the adjustable strength exercise device 10. Furthermore, variations and modifications of the foregoing are within the scope of the adjustable strength exercise device. It is understood that the adjustable strength exercise device as disclosed herein extends to all alternative combinations of one or more of the individual features mentioned, evident from the text and/or drawings, and/or inherently disclosed. All of these different combinations constitute various alternative aspects of the adjustable strength exercise device. The embodiments described herein explain the best modes known for practicing the adjustable strength exercise device and will enable others skilled in the art to utilize the same. The claims are to be construed to include alternative embodiments to the extent permitted by the prior art.

The invention claimed is:

1. A wrist and elbow exercise device for treatment of physical conditions including pronator syndrome and general weakness after upper extremity surgery, the wrist and elbow exercise device comprising:

a. a resistance band having a first end and a second end;

b. a body configured as a bisected working circle, the body further comprising:

i. an outer perimeter, the outer perimeter having a groove positioned therein, the outer perimeter further comprising a first quadrant, a second quadrant, a third quadrant, and a fourth quadrant, wherein the fourth quadrant is non-symmetrical to the first quadrant, the second quadrant and the third quadrant, wherein the fourth quadrant is elliptical in shape;

ii. a grip configured for engagement with a user's hand interiorly positioned; and, iii. a pair of d-shaped slots wherein each of the d-shaped slots is adjacent the grip;

c. wherein the first end of the resistance band is affixed to the body so as to position a portion of the resistance band in the groove during use and the second end of the resistance band is configured to be engaged by the user so as to create tension in the resistance band during use.

2. The wrist and elbow exercise device according to claim 1 wherein the handle is defined to extend above a plane of a thickness of the bisected working circle.

3. The wrist and elbow exercise device according to claim 2 wherein the handle is further defined to have an ovalular shape.

4. The wrist and elbow exercise device according to claim 1 wherein the first end of the resistance band is affixed in a hole positioned in a d-shaped slot of the pair of d-shaped slots.

5. The wrist and elbow exercise device according to claim 1 wherein the body is configured to be rotated back and forth during use.

6. The wrist and elbow exercise device according to claim 5 wherein the body is configured to be rotated back and forth during use so that the fourth quadrant is acting upon the resistance band positioned in the outer groove.

7. The wrist and elbow exercise device according to claim 6 wherein the fourth quadrant is acting upon the resistance band positioned in the outer groove to increase an amount of work required by the user to continue rotating the wrist and elbow exercise device through the fourth quadrant.

8. A method of exercising a user's arm to treat pronator syndrome comprising:

a. selecting a user's arm to be exercised;

b. positioning the arm so that a forearm is perpendicular to an upper arm;

c. engaging a hand of the user of the arm with a grip, the grip positioned in the interior of a body configured as a bisected working circle, the body further comprising:

i. an outer perimeter, the outer perimeter having a groove positioned therein, the outer perimeter further comprising a first quadrant, a second quadrant, a third quadrant, and a fourth quadrant, wherein the fourth quadrant is non-symmetrical to the first quadrant, the second quadrant and the third quadrant, wherein the fourth quadrant is elliptical in shape;

ii. the grip configured for engagement with the user's hand; and, iii. a pair of d-shaped slots wherein each of the pair of d-shaped slots is adjacent the grip; and, iv. a resistance band having a first and second end, wherein the first end is affixed to the body so as to position a portion of the resistance band in the groove during use and the second end of the resistance band is configured to be engaged by the user so as to create tension in the resistance band during use;

rotating the body in a first direction to exercise the user's arm by increasing tension on the resistance band; and, d. rotating the body in a second direction to release tension on the user's arm, wherein the second direction is opposite the first direction.

9. The method of exercising the user's arm to treat pronator syndrome according to claim 8 wherein the first end of the resistance band is affixed in a hole positioned in a d-shaped slot of the pair of d-shaped slots.

10. The method of exercising the user's arm to treat pronator syndrome according to claim 8 wherein the body is rotated back and forth during use to exercise muscle of the wrist or forearm of the user's arm.

11. The method of exercising the user's arm to treat pronator syndrome according to claim 8 wherein the second end of the resistance band is configured with a hook to aid in securement and affixment.

* * * * *